US009898977B2

(12) United States Patent
Chen et al.

(10) Patent No.: US 9,898,977 B2
(45) Date of Patent: Feb. 20, 2018

(54) METHOD FOR CONTROLLING IMAGE DISPLAY

(71) Applicant: Shenzhen China Star Optoelectronics Technology Co., Ltd., Shenzhen, Guangdong (CN)

(72) Inventors: Yu Yeh Chen, Guangdong (CN); Wenqin Zhao, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 14/785,989

(22) PCT Filed: Jun. 4, 2015

(86) PCT No.: PCT/CN2015/080821
§ 371 (c)(1),
(2) Date: Dec. 31, 2015

(87) PCT Pub. No.: WO2016/179867
PCT Pub. Date: Nov. 17, 2016

(65) Prior Publication Data

US 2017/0162137 A1 Jun. 8, 2017

(30) Foreign Application Priority Data

May 12, 2015 (CN) ..... 2015 1 0239875

(51) Int. Cl.
*G09G 3/36* (2006.01)

(52) U.S. Cl.
CPC ... *G09G 3/3607* (2013.01); *G09G 2320/0257* (2013.01); *G09G 2320/0295* (2013.01); *G09G 2320/0626* (2013.01)

(58) Field of Classification Search
CPC ..... G09G 3/3607; G09G 2320/0257; G09G 2320/0295; G09G 2320/0626
See application file for complete search history.

(56) References Cited

U.S. PATENT DOCUMENTS

2008/0136761 A1 6/2008 Hong et al.
2016/0005370 A1* 1/2016 Liu ..... G09G 3/3611 345/691

FOREIGN PATENT DOCUMENTS

CN 1804966 7/2006
CN 101110194 1/2008
(Continued)

OTHER PUBLICATIONS

International Search Report and Written Opinion for International Application No. PCT/CN2015/080821, dated Feb. 3, 2016.
(Continued)

*Primary Examiner* — Charles Hicks
(74) *Attorney, Agent, or Firm* — Kim Winston LLP

(57) ABSTRACT

A method for controlling image display is disclosed. The method comprises the following steps: determining whether a still image appears; obtaining, when a still image appears, an actual gray-scale of each pixel of said still image, and generating a plurality of output gray-scales corresponding to the actual gray-scale; and substituting the actual gray-scale with said output gray-scales alternately, and forming dynamic image output. According to the present disclosure, the still image can be converted into dynamic image output through controlling the image display in spatial domain and time domain, and thus the problem of afterimage of the still image can be solved.

9 Claims, 2 Drawing Sheets

(56) References Cited

FOREIGN PATENT DOCUMENTS

| | | |
|---|---|---|
| CN | 101131489 | 2/2008 |
| CN | 101256731 | 9/2008 |
| CN | 101261814 | 9/2008 |
| CN | 101286303 | 10/2008 |
| CN | 101593494 | 12/2009 |
| CN | 103778897 | 5/2014 |

OTHER PUBLICATIONS

Chinese Office Action and Search Report for Chinese Patent Application No. 201510239875.1, dated Apr. 1, 2017.

* cited by examiner

METHOD FOR CONTROLLING IMAGE DISPLAY

CROSS REFERENCE TO RELATED APPLICATION

The present application claims benefit of Chinese patent application CN 201510239875.1, entitled "Method for Controlling Image Display" and filed on May 12, 2015, the entirety of which is incorporated herein by reference.

FIELD OF THE INVENTION

The present disclosure relates to the technical field of liquid crystal display, and particularly to a method for controlling image display in a liquid crystal display device.

BACKGROUND OF THE INVENTION

With the development towards full color gamut, low color shift, and high resolution, there is a higher requirement for the reliability of Thin Film Transistor Liquid Crystal Display (TFT-LCD) products. When a same still image is displayed in a TFT-LCD for a long time, the liquid crystal molecules cannot rotate normally under the control of the signal voltage since the liquid crystal molecules are polarized after being driven for a long time. Consequently, when the image displayed therein is changed after a certain time period, the trace of the previous still image can yet be seen. That is, the afterimage of the previous still image is left.

SUMMARY OF THE INVENTION

In order to solve the aforesaid technical problem, the present disclosure provides a method for controlling image display, whereby the afterimage of a still image can be eliminated.

According to one embodiment of the present disclosure, a method for controlling image display is provided. The method comprises the following steps:

determining whether a still image appears;

obtaining, when a still image appears, an actual gray-scale of each pixel of said still image, and generating a plurality of output gray-scales corresponding to the actual gray-scale; and substituting the actual gray-scale with said output gray-scales alternately, and forming dynamic image output.

According to one embodiment of the present disclosure, brightness of said actual gray-scale is equal to common brightness of the plurality of output gray-scales corresponding to the actual gray-scale.

According to one embodiment of the present disclosure, the plurality of output gray-scales comprise a first output gray-scale and a second output gray-scale that are different from each other; and wherein the first output gray-scale represents a high gray-scale relative to the actual gray-scale, and the second output gray-scale represents a low gray-scale relative to the actual gray-scale.

According to one embodiment of the present disclosure, the first output gray-scale and the second output gray-scale corresponding to the actual gray-scale are obtained through inquiring a pre-set gray-scale table.

According to one embodiment of the present disclosure, the step of forming dynamic image output further comprises:

generating a first image and a second image based on the first output gray-scale and the second output gray-scale corresponding to the actual gray-scale of each pixel, and substituting an actual gray-scale image with said first image and said second image in a predetermined manner alternately so as to form dynamic image output, wherein when said first image and said second image are output, the first output gray-scale or the second output gray-scale corresponding to the actual gray-scale of each pixel is output.

According to one embodiment of the present disclosure, when said first image and said second image are output, an output order of the output gray-scales of each pixel is different from an output order of the output gray-scales of adjacent pixels.

According to one embodiment of the present disclosure, substituting the actual gray-scale image with said first image and said second image in a predetermined manner alternately so as to form dynamic image output comprises: outputting said first image and said second image alternately and repeatedly taking one frame image as a cycling unit.

According to one embodiment of the present disclosure, substituting the actual gray-scale image with said first image and said second image in a predetermined manner alternately so as to form dynamic image output comprises: outputting two consecutive frames of said first image and two consecutive frames of said second image alternately and repeatedly taking two frame images as a cycling unit.

According to one embodiment of the present disclosure, the step of determining whether a still image appears further comprises:

determining whether a next frame image received therein is the same as a previous frame image, if a determination result is positive, repeat times that the same image appears is calculated; and if the determination result is negative, a calculation number is returned to zero; and determining, when the same image appears, whether the repeat times that the same image appears is larger than or equal to a pre-set value, if a determination result is positive, it shows that a still image appears; and if the determination result is negative, it shows that a still image does not appear.

According to one embodiment of the present disclosure, the first output gray-scale and the second output gray-scale corresponding to the actual gray-scale are obtained through pretest and are changeable.

According to the present disclosure, the image displayed in the LCD can be controlled through the combination of spatial domain and time domain, whereby the still image can be converted into dynamic image output, and thus the technical problem of the afterimage of a still image displayed therein can be solved.

Other features and advantages of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The accompanying drawings provide further understandings of the present disclosure and constitute one part of the description. The drawings are used for interpreting the present disclosure together with the embodiments, not for limiting the present disclosure. In the drawings.

DETAILED DESCRIPTION OF THE EMBODIMENTS

The present disclosure will be illustrated in detail hereinafter in combination with the accompanying drawings to make the purpose, technical solutions, and advantages of the present disclosure more clear.

The afterimage is also referred to as image spiking, which refers to the phenomenon that when a same still image is displayed for a long time, a previous image is left after the display content is changed. The afterimage problem exists in all LCDs more or less.

Figure 1:
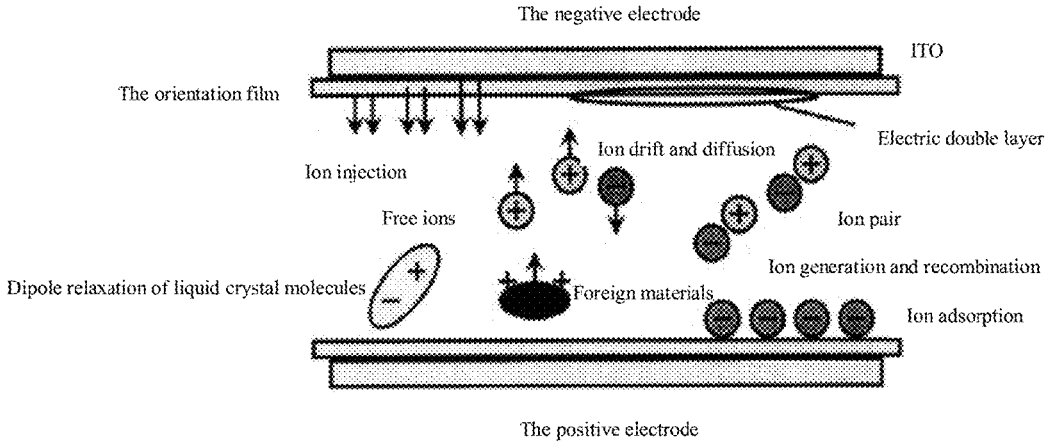
FIG. 1 schematically shows the principle of an afterimage generated in a liquid crystal display panel.

FIG. 1 schematically shows the principle of an afterimage generated in a liquid crystal display panel. When a still image is displayed in a display panel for a long time, the ions in the panel would move along a direction of an electric field and aggregate on the liquid crystal orientation layer, and an internal electric field would be generated by the aggregated ions. When other images are displayed, a residual direct voltage would exist on the liquid crystal molecules since the ions aggregated on the orientation layer cannot leave the orientation layer. The direct voltage would form an internal electric field, and thus the liquid crystal molecules are polarized with a certain rotation angle and cannot be changed. In this manner, when a next image is displayed, a trace of a previous image would be left on the display panel, and thus an afterimage would be generated. Therefore, the present disclosure provides a method for controlling image display to eliminate the afterimage of the liquid crystal display panel.

Figure 2:
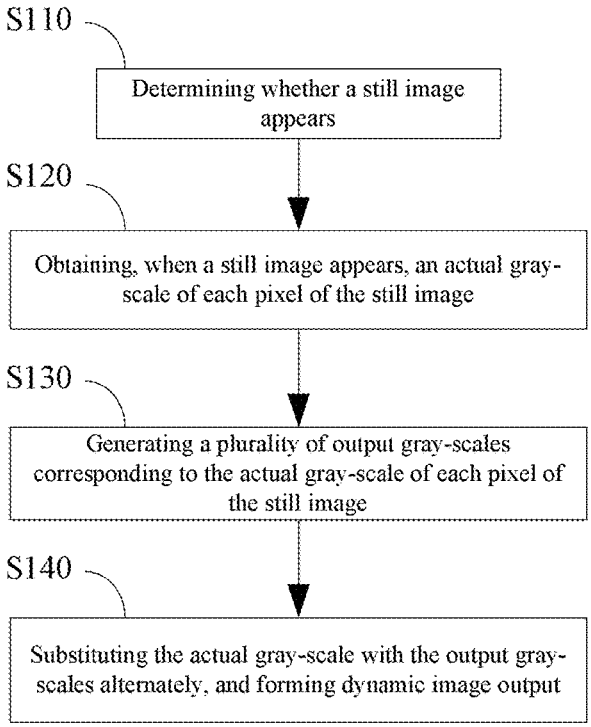
FIG. 2 is a flow chart of a method according to one embodiment of the present disclosure.
Figure 3:
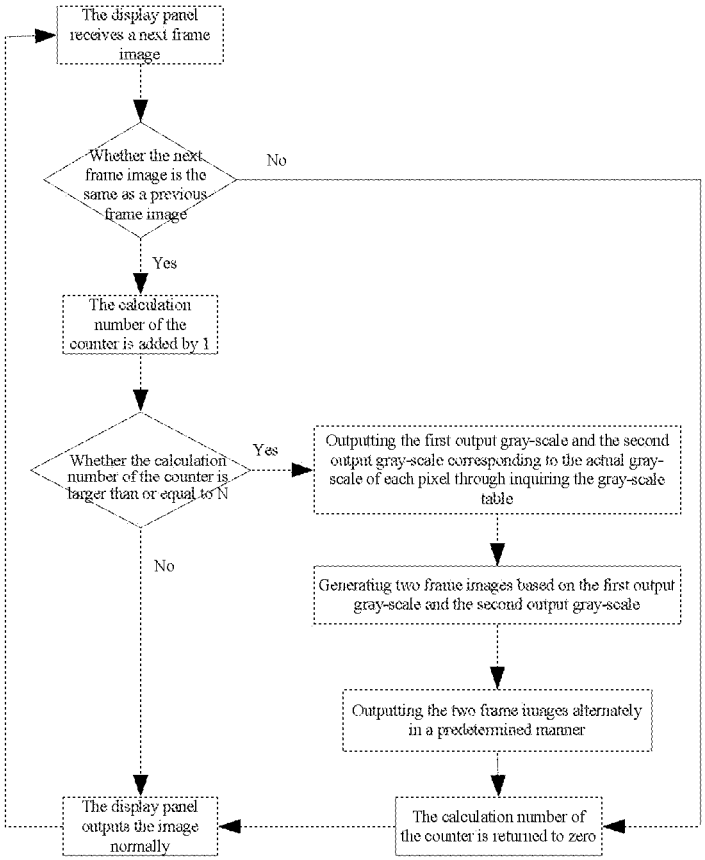
FIG. 3 is an algorithm chart according to the embodiment of the present disclosure.

FIG. 2 is a flow chart of the method according to one embodiment of the present disclosure, and FIG. 3 is an algorithm chart according to the embodiment of the present disclosure. The present disclosure will be illustrated in detail hereinafter with reference to FIGS. 2 and 3.

First, in step S110, whether a still image appears is determined. In this step, whether a still image appears can be determined through a duration of a same image displayed on the panel.

Specifically, whether a still image appears on the liquid crystal display panel can be determined based on the algorithm chart as shown in FIG. 3. When a next frame image is received, whether the next frame image received therein is the same as a previous frame image is determined. If a determination result is positive, repeat times that the same image appears is calculated; and if a determination result is negative, a calculation number is returned to zero.

The next frame image received therein and the previous frame image are compared. If a comparison result shows that the two frame images are the same as each other, the repeat times that the same image appears is calculated. The repeat times that the same image appears corresponds to the duration of the same image. The repeat times that the same image appears can be calculated through the counting method as shown in FIG. 3. When the determination result is that the next frame image is the same as the previous frame image, the calculation number of the counter increases by 1, which shows that the same image appears once again. When the determination result is that the next frame image is different from the previous frame image, the calculation number of the counter is returned to zero. In this case, it can be ensured that the counter counts from zero when the case that the next frame image is the same as the previous frame image occurs for the first time.

Then, whether the repeat times that the same image appears is larger than or equal to a pre-set value N is determined. The pre-set value is used for indicating that a still frame, i.e., a still image appears on the display panel. Here, it is considered that the still image appears when the same frame images accumulate continuously to a certain amount (which corresponds to the calculation number of the counter). For example, the calculation number of the counter corresponding to the pre-set value can be set to be 10 or other values. When the repeat times is larger than or equal to the pre-set value, it is considered that the still image appears, and a corresponding treatment shall be performed on the still image.

When the repeat times that the same image appears is less than the pre-set value, or when the next frame image is different from the previous frame image, a non-still image is displayed. In this case, a corresponding treatment shall be performed on the counter, and the display device outputs the received present frame image normally.

Next, in step S120, when a still image appears, an actual gray-scale of each pixel of said still image is obtained. Since at this time, the previous frame image is the same as the next frame image, the actual gray-scale of each pixel of the still image can be obtained through any frame image.

In the following, in step S130, a plurality of output gray-scales corresponding to the actual gray-scale of each pixel of the still image are generated. In order to guarantee the brightness of the display panel, according to one embodiment of the present disclosure, the brightness of the actual gray-scale is equal to the common brightness of the plurality of output gray-scales corresponding to the actual gray-scale. According to one embodiment of the present disclosure, in order to facilitate the design thereof, the plurality of output gray-scales are configured to comprise a first output gray-scale and a second output gray-scale that are different from each other, wherein the first output gray-scale represents a high gray-scale relative to the actual gray-scale, and the second output gray-scale represents a low gray-scale relative to the actual gray-scale. The common brightness of the first output gray-scale and the second output gray-scale is equal to the brightness of the actual gray-scale.

According to one embodiment of the present disclosure, the first output gray-scale and the second output gray-scale corresponding to each actual gray-scale are obtained through inquiring a preset gray-scale table. The gray-scale table can be established through the following steps.

First, the first output gray-scale and the second output gray-scale corresponding to each actual gray-scale are obtained through pretest. Since it should only be guaranteed that the common brightness of the first output gray-scale and the second output gray-scale is equal to the brightness of the actual gray-scale, the first output gray-scale and the second output gray-scale corresponding to the actual gray-scale can be configured to be combinations of different values. That is, the values of the first output gray-scale and the second output gray-scale corresponding to the actual gray-scale are changeable. The specific values can be obtained through debugging by a debugging tool, and a specific gray-scale table is shown in Table 1.

As shown in Table 1, the received gray-scale represents the actual gray-scale of the pixel, the output gray-scale h represents the first output gray-scale corresponding to the actual gray-scale, and the output gray-scale 1 represents the second output gray-scale corresponding to the actual gray-scale. The two output gray-scales corresponding to the actual gray-scale of each pixel can be obtained through inquiring Table 1. The first output gray-scale is generally selected to be larger than the second output gray-scale, while the first output gray-scale and the second output gray-scale shall be configured specially at the minimum value and the maximum value of the actual gray-scale. As shown in Table 1, the output gray-scale h corresponding to 128 gray-scale is 135 gray-scale, and the output gray-scale 1 corresponding to 128 gray-scale is 119 gray-scale. The common brightness of 135 gray-scale and 119 gray-scale is the same as the brightness of 128 gray-scale. The specific values of the output gray-scale h and the output gray-scale 1 can be obtained through debugging by CA-320. Moreover, as shown in Table 1, since there is not a gray-scale that is lower than gray-scale 0, when the output gray-scales corresponding to the actual gray-scale 0 are determined, the output gray-scale h can be configured to be 3 gray-scale, and the output gray-scale 1 can be 0 gray-scale. The actual brightness corresponding to 0 gray-scale shall take the fact that the flicker cannot be seen by the naked eye as the standard. The actual gray-scale 255 shall be treated similarly.

TABLE 1

| The received gray-scale | The output gray-scale h | The output gray-scale l |
|---|---|---|
| 0 | 3 | 0 |
| . . . | . . . | . . . |
| . . . | . . . | . . . |
| 128 | 135 | 119 |
| . . . | . . . | . . . |
| . . . | . . . | . . . |
| 255 | 255 | 253 |

Then, in step S140, the actual gray-scale is substituted with the plurality of output gray-scales alternately so as to form dynamic image output. The step of forming dynamic image output further comprises: generating a first image and a second image based on the first output gray-scale and the second output gray-scale corresponding to the actual gray-scale of each pixel, and substituting an actual gray-scale image with said first image and said second image in a predetermined manner alternately so as to form dynamic image output. When said first image and said second image are output, the first output gray-scale or the second output gray-scale corresponding to the actual gray-scale of each pixel is output.

Figure 4:
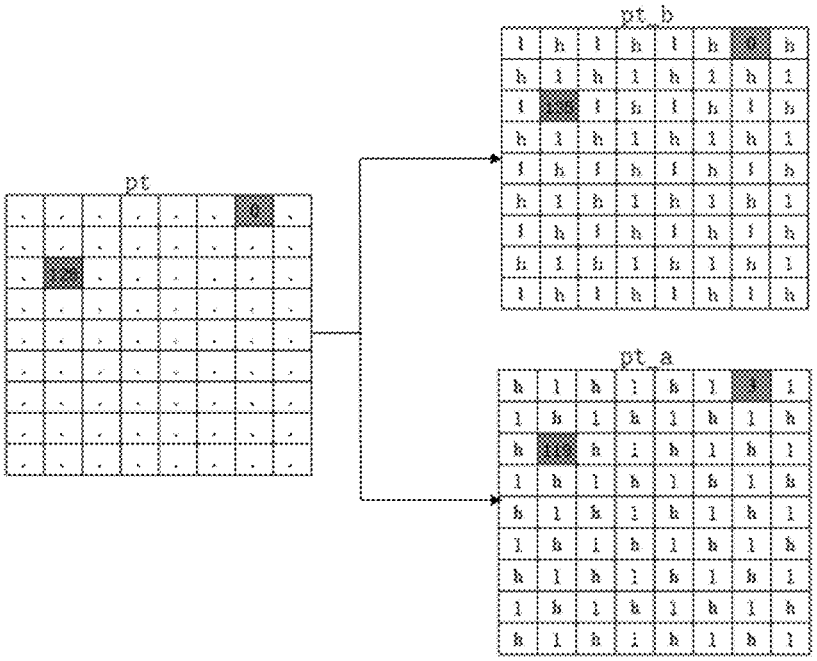
FIG. 4 schematically shows an actual gray-scale image and corresponding output gray-scale images according to the embodiment of the present disclosure.

In this step, the second image can be formed after the output gray-scales of each pixel in the first image are converted, i.e., the second image can be formed after the first output gray-scale of the first image is converted into the second output gray-scale or the second output gray-scale of the first image is converted into the first output gray-scale, and vice versa. That is, an output order of the output gray-scales of each pixel in the first image is different from that in the second image. As shown in FIG. 4, the actual gray-scale image pt corresponds to two output images, i.e., the first image pt-a and the second image pt-b. Taking the actual gray-scales of two pixels in the actual gray-scale image pt, i.e., 128 gray-scale and 0 gray-scale as an example, the output order of the output gray-scale corresponding to 128 gray-scale in the first image pt-a is different from that in the second image pt-b, and the output order of the output gray-scale corresponding to 0 gray-scale in the first image pt-a is also different from that in the second image pt-b.

According to one embodiment of the present disclosure, in order to guarantee the total brightness of the whole display panel and avoid over bright or over dark display effect, when the first image and the second image are output, in spatial domain, an output order of the output gray-scales of each pixel is different from an output order of the output gray-scales of adjacent pixels. As shown in FIG. 4, in the first image pt-a and the second image pt-b, when the output gray-scale of one pixel is the first output gray-scale (i.e., the output gray-scale h), four adjacent pixels at the up side, down side, right side, and left side of the pixel respectively all output the second output gray-scale (i.e., the output gray-scale l). Similarly, when the output gray-scale of one pixel is the second output gray-scale, four adjacent pixels at the up side, down side, right side, and left side of the pixel respectively all output the first output gray-scale.

When the actual gray-scale image is substituted with the first image and the second image in a predetermined manner alternately so as to form dynamic image output, different alternating combination modes of the first image and the second image can be adopted. According to one embodiment of the present disclosure, one frame of the first image pt-a and one frame of the second image pt-b are output alternately in time domain taking one frame image as a cycling unit. According to another embodiment of the present disclosure, two consecutive frames of the first image pt-a and two consecutive frames of the second image pt-b are output alternately taking two frame images as a cycling unit. In this manner, during the duration of the still image, the first image pt-a and the second image pt-b are output alternately and repeatedly in a predetermined manner. When the two images are output alternately, each pixel of the display panel is applied with two different output gray-scales, so that an electric field of the liquid crystal panel changes. In this case, an internal electric field generated by ion aggregation inside the display panel can be avoided, and the case that the liquid crystal molecules are polarized by the internal electric field with a certain rotation angle and cannot be changed can be avoided, thereby eliminating the afterimage resulted from the over long duration of a still image. Of course, the methods in which the first image pt-a and the second image pt-b are output alternately are not limited by the above two methods, and the images which are output alternately are not limited by the above two images.

In this step, during the procedure that the first image pt-a and the second image pt-b are output alternately, each time after one frame of the first image pt-a or one frame of the second image pt-b is output, the repeat times that the same image appears is returned to zero (i.e., the calculation number of the counter is returned to zero), and the display panel receives and displays images normally. Then, if the image received therein is the same as the previous image, when the repeat times that the same image appears reaches a preset value, the following steps will be performed. For example, when one frame image is taken as a cycling unit, if the first image pt-a is output before the calculation number of the counter is returned to zero, the second image pt-b is output at this time, and if the second image pt-b is output before the calculation number of the counter is returned to zero, the first image pt-a is output at this time. And for another example, when two frame images are taken as a cycling unit, if the first image pt-a is output before the calculation number of the counter is returned to zero, the first image pt-a is output at this time, the second image pt-b is output then, and the second image pt-b is output in the following. The images are output in the above manners repeatedly on the same principle.

According to the present disclosure, whether a still image appears can be determined through the detection thereof, and the problem of afterimage of the still image can be solved through controlling the images displayed on the display panel in spatial domain and time domain.

The above embodiments are described only for better understanding, rather than restricting, the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. A method for controlling image display, comprising the following steps:

determining whether a still image appears;

obtaining, when a still image appears, an actual gray-scale of each pixel of said still image, and generating a plurality of output gray-scales corresponding to the actual gray-scale; and substituting the actual gray-scale with said output gray-scales alternately, and forming dynamic image output, wherein the plurality of output gray-scales comprise a first output gray-scale and a second output gray-scale that are different from each other; and wherein the first output gray-scale represents a high gray-scale relative to the actual gray-scale, and the second output gray-scale represents a low gray-scale relative to the actual gray-scale, wherein the step of forming dynamic image output further comprises: generating a first image and a second image based on the first output gray-scale and the second output gray-scale corresponding to the actual gray-scale of each pixel, and substituting an actual gray-scale image with said first image and said second image in a predetermined manner alternately so as to form dynamic image output, wherein when said first image and said second image are output, the first output gray-scale or the second output gray-scale corresponding to the actual gray-scale of each pixel is output, and wherein when said first image and said second image are output, an output order of the output gray-scales of each pixel is different from an output order of the output gray-scales of adjacent pixels.

2. The method according to claim 1, wherein brightness of said actual gray-scale is equal to common brightness of the plurality of output gray-scales corresponding to the actual gray-scale.

3. The method according to claim 1, wherein the first output gray-scale and the second output gray-scale corresponding to the actual gray-scale are obtained through inquiring a pre-set gray-scale table.

4. The method according to claim 1, wherein substituting the actual gray-scale image with said first image and said second image in a predetermined manner alternately so as to form dynamic image output comprises: outputting one frame of said first image and one frame of said second image alternately and repeatedly taking one frame image as a cycling unit.

5. The method according to claim 1, wherein substituting the actual gray-scale image with said first image and said second image in a predetermined manner alternately so as to form dynamic image output comprises: outputting two consecutive frames of said first image and two consecutive frames of said second image alternately and repeatedly taking two frame images as a cycling unit.

6. The method according to claim 1, wherein the step of determining whether a still image appears further comprises:

determining whether a next frame image received therein is the same as a previous frame image, if a determination result is positive, repeat times that the same image appears is calculated; and if the determination result is negative, a calculation number is returned to zero; and determining, when the same image appears, whether the repeat times that the same image appears is larger than or equal to a pre-set value, if a determination result is positive, it shows that a still image appears; and if the determination result is negative, it shows that a still image does not appear.

7. The method according to claim 1, wherein the first output gray-scale and the second output gray-scale corresponding to the actual gray-scale are predetermined and are changeable.

8. The method according to claim 3, wherein substituting the actual gray-scale image with said first image and said second image in a predetermined manner alternately so as to form dynamic image output comprises: outputting one frame of said first image and one frame of said second image alternately and repeatedly taking one frame image as a cycling unit.

9. The method according to claim 3, wherein substituting the actual gray-scale image with said first image and said second image in a predetermined manner alternately so as to form dynamic image output comprises: outputting two consecutive frames of said first image and two consecutive frames of said second image alternately and repeatedly taking two frame images as a cycling unit.

* * * * *